US009622593B2

(12) United States Patent
Longenecker et al.

(10) Patent No.: US 9,622,593 B2
(45) Date of Patent: Apr. 18, 2017

(54) PINCH FREE FOLDING LOCK

(71) Applicant: ARTSANA USA, INC., Lancaster, PA (US)

(72) Inventors: Michael L. Longenecker, Lancaster, PA (US); James M. Dillner, Leola, PA (US)

(73) Assignee: ARTSANA USA, INC., Lancaster, PA (US)

( * ) Notice: Subject to any disclaimer, the term of this patent is extended or adjusted under 35 U.S.C. 154(b) by 198 days.

(21) Appl. No.: 14/590,770

(22) Filed: Jan. 6, 2015

(65) Prior Publication Data

US 2015/0196135 A1 Jul. 16, 2015

Related U.S. Application Data

(60) Provisional application No. 61/927,262, filed on Jan. 14, 2014.

(51) Int. Cl.

| | |
|---|---|
| ***F16B 7/10*** | (2006.01) |
| ***F16C 11/00*** | (2006.01) |
| ***F16D 1/12*** | (2006.01) |
| ***A47D 13/06*** | (2006.01) |

(52) U.S. Cl.
CPC ..... *A47D 13/063* (2013.01); *Y10T 403/32008* (2015.01)

(58) Field of Classification Search
CPC ..... Y10T 403/32008; Y10T 403/32401; Y10T 403/32409; Y10T 403/32426; Y10T 403/32442; Y10T 403/32451; Y10T 403/32459; Y10T 16/54024; Y10T 16/540247; Y10T 16/54025; Y10T 16/5407; A47D 7/00; A47D 13/06; A47D 13/063; E04H 15/34; E04H 15/44; E04H 15/48; E04H 15/405
USPC ..... 403/52–54, 86, 87, 102, 320; 5/93.1, 5/99.1, 655; 256/25
See application file for complete search history.

(56) References Cited

U.S. PATENT DOCUMENTS

| | | | |
|---|---|---|---|
| 4,069,524 | A | 1/1978 | Carlo |
| 4,357,735 | A | 11/1982 | Saint et al. |
| 4,934,025 | A | 6/1990 | Mariol |
| 5,251,359 | A | 10/1993 | Finkl |
| 5,611,634 | A | 3/1997 | Wang |
| 5,615,427 | A | 4/1997 | Huang |
| 5,857,229 | A | 1/1999 | Magnani, Jr. |
| 6,202,229 | B1 | 3/2001 | Cheng |
| 6,364,563 | B1 | 4/2002 | Cheng |

(Continued)

*Primary Examiner* — Michael P Ferguson
*Assistant Examiner* — Nahid Amiri
(74) *Attorney, Agent, or Firm* — Patent Law Associates

(57) ABSTRACT

A folding lock assembly for use in a frame for a portable child enclosure that includes a body housing first and second hinges for connecting a pair of equal-length side frame members. The hinges are limited in the degree of pivotal movement permitted between a locked position in which the frame members are linearly aligned and a folded position in which the frame members are substantially parallel. The first hinge permits angular rotation less than 90 degrees while the second hinge permits angular rotation greater than 90 degrees. The differences in the range of hinge rotation offset the distal ends of the frame when the connected members are folded to eliminate a pinch point between frame end members.

17 Claims, 11 Drawing Sheets

(56) References Cited

U.S. PATENT DOCUMENTS 6,510,568 B1 * 1/2003 Drobinski ..... A47D 7/002 5/93.1
6,711,783 B2 3/2004 LeMole
6,729,791 B1 5/2004 Chen
6,954,949 B1 * 10/2005 Chen ..... A47D 13/063 5/93.1
7,108,443 B2 9/2006 Chen
7,284,288 B2 10/2007 Cheng
7,293,304 B2 * 11/2007 Chen ..... A47D 13/063 5/98.1
7,380,311 B2 6/2008 Chen
7,552,487 B2 * 6/2009 Chen ..... A47D 13/063 248/292.12
7,591,031 B2 * 9/2009 Yang ..... A47D 13/063 5/93.1
7,937,786 B2 5/2011 Bergkvist
7,958,601 B2 6/2011 Yu et al.
8,069,533 B2 12/2011 Yu et al.
8,387,178 B2 3/2013 Rivera et al.
8,505,136 B2 * 8/2013 Yu ..... A47D 13/063 403/100
8,955,175 B2 * 2/2015 Wiegmann ..... A47D 13/061 256/25
8,966,680 B2 * 3/2015 Dowd ..... A47D 13/063 5/98.1
2003/0061657 A1 * 4/2003 Longenecker ..... A47D 13/063 5/99.1
2003/0061658 A1 4/2003 Longenecker
2004/0127825 A1 * 7/2004 Castillo ..... A61F 5/0123 602/5
2006/0021136 A1 2/2006 Cheng
2006/0021138 A1 * 2/2006 Waldman ..... A47D 13/063 5/99.1
2006/0225208 A1 10/2006 Chen
2007/0163041 A1 7/2007 Cheng et al.
2011/0217111 A1 * 9/2011 Wu ..... F16B 7/00 403/53
2011/0229251 A1 * 9/2011 Yeh ..... A47D 13/063 403/81
2012/0139317 A1 * 6/2012 Fahl ..... B60N 2/206 297/362.11
2013/0074257 A1 3/2013 Mendes et al.
2013/0160205 A1 6/2013 Dowd et al.
2013/0239382 A1 9/2013 Cheng

* cited by examiner

PINCH FREE FOLDING LOCK

CROSS REFERENCE TO RELATED APPLICATIONS

This application claims the benefit of priority of U.S. Provisional Application 61/927,262, filed Jan. 14, 2014.

BACKGROUND OF THE INVENTION

The present application relates generally to the field of collapsible enclosures for infants and toddlers and, more particularly, to a folding lock mechanism for a collapsible frame that eliminates pinch points on the frame.

Cribs, play yards, and other portable enclosures are useful to contain and provide a safe environment for small children to sleep or play. Such enclosures generally include side walls and a bottom floor made of fabric material or similar soft goods supported on a collapsible frame that allows the enclosure to be easily reconfigured for use for storage or transport. The drive to minimize the space necessary to contain a collapsed frame has resulted in a relatively congested array of frame members when the frames are collapsed. With this increased congestion comes the potential to create pinch points within the framework, especially as normally spaced-apart frame members are moved into adjacent contact with one another. Continuing refinements in folding frames reinforce the need for folding frame designs to consider potential pinch points and to seek to minimize, if not eliminate any such hazards to the user.

SUMMARY OF THE INVENTION

Accordingly, the present invention, in any of the embodiments described herein, may provide one or more of the following advantages:

According to one embodiment of the present invention, a folding frame includes a folding lock mechanism that retains a pair of connected members in a locked arrangement for use of the frame and a folded arrangement which allows the connected members to be angled in relation to one another so that the frame may be collapsed. Two such folding lock mechanisms are preferable included so that a two-dimensional frame may be formed wherein the folding lock mechanisms are symmetrically disposed therein. Each folding lock includes a body, and first and second hinges, one of the frame members being connected to each hinge. The hinges are limited in the degree of pivotal movement permitted between the locked position and the folded position, the first hinge permitting angular rotation less than 90 degrees and the second hinge permitting angular rotation greater than 90 degrees. The differences in the range of hinge rotation offset the distal ends of the frame when the connected members are folded to a position in which they are generally parallel.

The folding lock hinges are capable of being locked into a position, generally corresponding to the frame in its fully expanded configuration such as it would be for use, so that movement of the connected frame members is inhibited. A convenient release mechanism allows the hinges to pivot and the frame members to be moved into a more compact configuration for storage of the frame. The release mechanism is preferably configured to automatically lock the hinges when the frame members are moved into the fully expanded alignment (e.g., unfolding the crib frame) without additional action by a user.

The folding locks are configured to minimize the creation of pinch points as the foldable frame is folded and unfolded. The first and second hinges are each shaped to minimize gaps between the pivoting elements and the fixed body as the hinge is moved.

The folding locks are configured to be of simple design, easy to use, and cost effective to manufacture.

These and other objects are achieved in accordance with the present invention by a folding lock assembly for use in a frame for a portable child enclosure that includes a body housing first and second hinges for connecting a pair of equal-length side frame members. The hinges are limited in the degree of pivotal movement permitted between a locked position in which the frame members are linearly aligned and a folded position in which the frame members are substantially parallel. The first hinge permits angular rotation less than 90 degrees while the second hinge permits angular rotation greater than 90 degrees. The differences in the range of hinge rotation offset the distal ends of the frame when the connected members are folded to eliminate a pinch point between frame end members.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail.

Also, any reference herein to the terms "up" or "down," or "top" or "bottom" are used as a matter of mere convenience, and are determined as a child playard would normally rest when deployed for use on a floor or a similarly level surface. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures.

Figure 1:
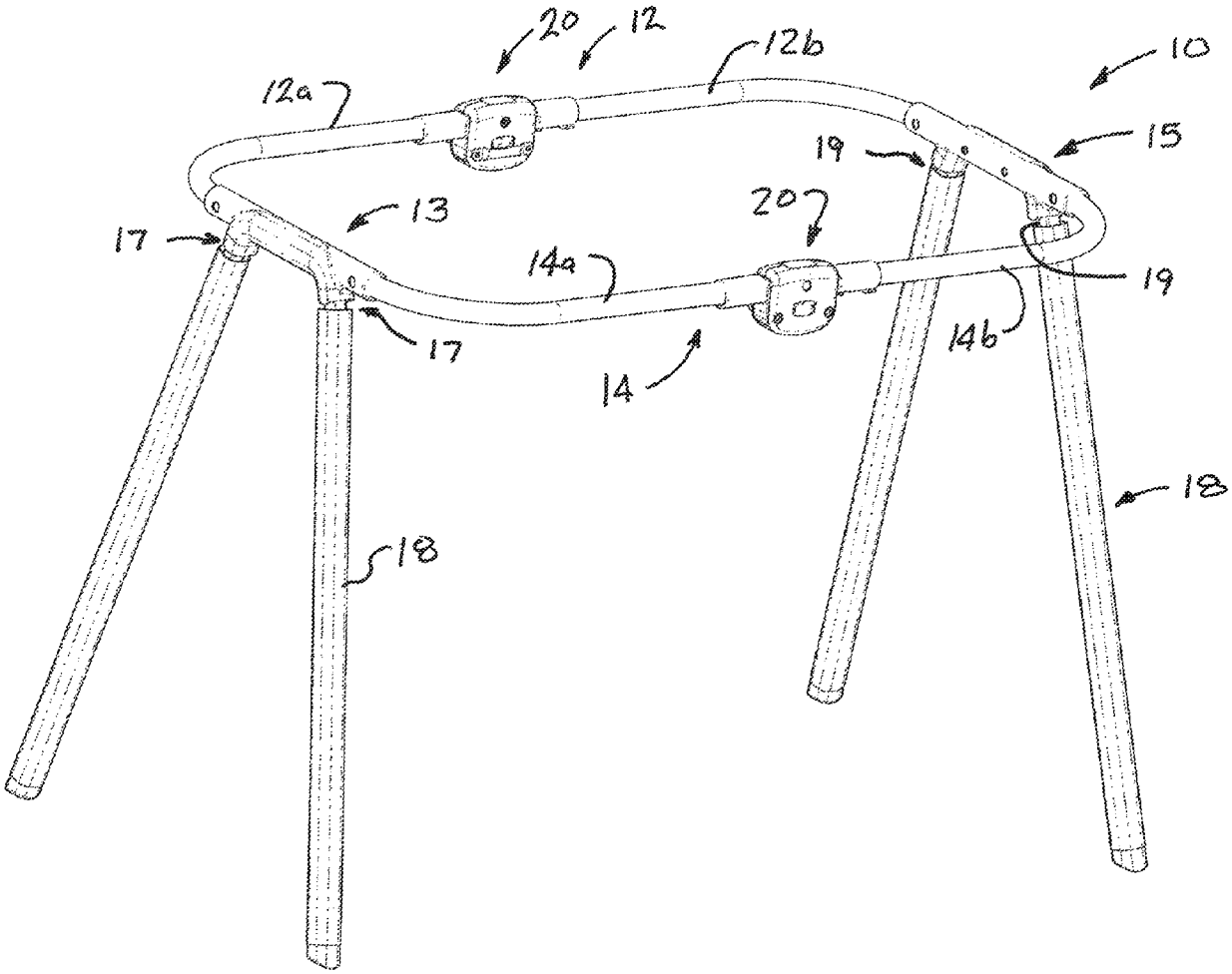
FIG. 1 is a perspective view of a folding frame commonly used with a portable child enclosure of the type on which the present invention is useful.
Figure 2:
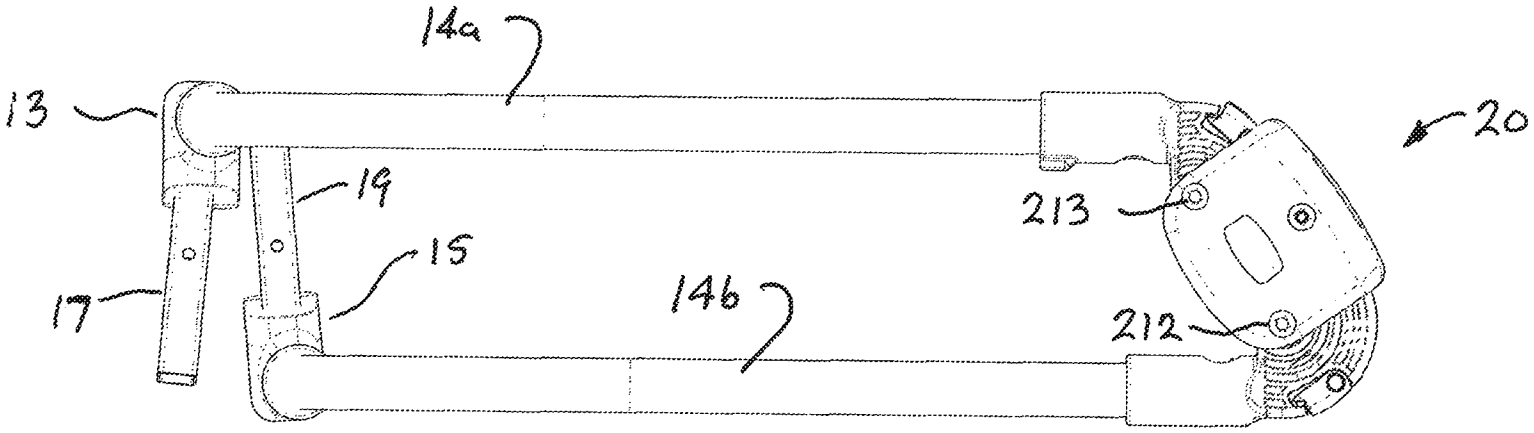
FIG. 2 is a second view of the folding frame of FIG. 1 shown in a folded positon illustrating an advantage of the present invention.
Figure 3:
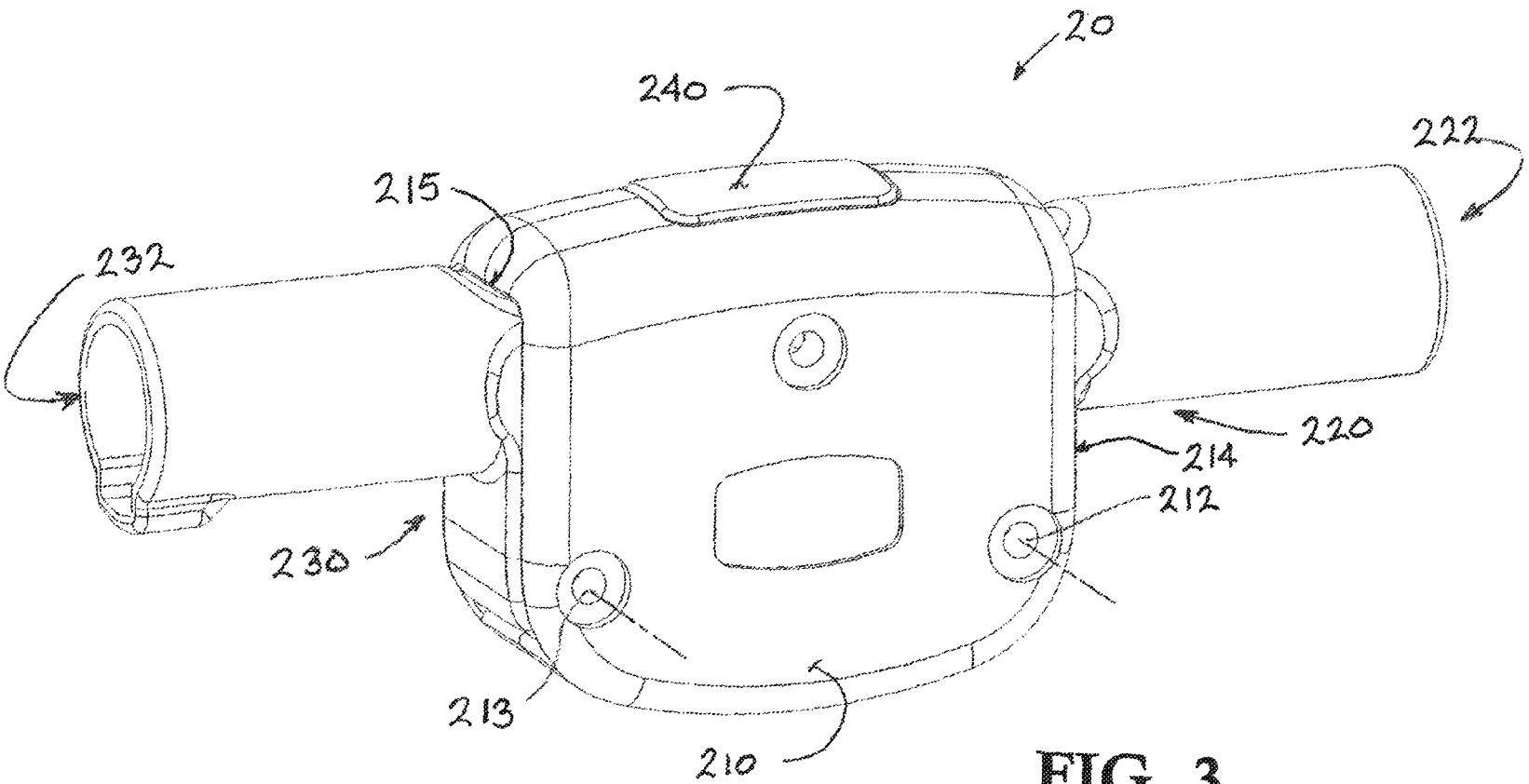
FIG. 3 is a perspective view of a folding lock assembly incorporating a first embodiment of the present invention.

FIGS. 1 and 2 illustrate a typical foldable frame 10 that is commonly referred to as a child's play yard. The foldable frame 10 comprises a pair of spaced-apart and generally parallel side frame members 12, 14 and a pair of spaced-apart and generally parallel end frame members 13, 15. The side and end frame members are connected to form frame 10. In the frame illustrated, the side and end frame members are generally perpendicularly arranged to form a rectangular frame 10 when in the unfolded configuration as shown. Legs 18, are shown connected to the end frame members 13, 15 to support the frame 10 at a convenient height above a surface.

The side frame members each include a folding lock mechanism 20 which divides the respective side frame members into a first portion 12*a*, 14*a* and a second portion 12*b*, 14*b*. The folding lock mechanisms 20 are typically positioned midway along the length of the side frame members 12, 14 to minimize the folded length of the frame 10. It is to be understood that a folding bassinet frame is used as an exemplary. The offset folding lock with pinch-free provision of the present invention can be used on a wide array of folding frames for which additional compactness is desired for the folded frame.

Some prior art frames require that the first and second portions be of different lengths in order to accommodate structures projecting from the end frame members. Referring specifically to FIG. 2, it can be seen that leg attachments 17, 19 extend from the end frame members away from the plane of the frame 10. When a fully symmetric frame is folded, these leg attachments can impact and limit the compactness of the folded frame. It is common to provide side frame portions of different lengths to offset the leg attachments to prevent contact between the opposing end attachments. The present invention alleviates the need to provide different length frame portions and instead provides a means to offset the end frame members using equal-length side frame portions and an offset lock assembly.

Now referring to FIGS. 3 through 8, a first embodiment of a folding lock assembly 20 is shown having a body 210 and a pair of frame connectors 220, 230 that hingedly connect to the body 210 for movement about pivots 212, 213. Each frame connector includes a receptacle 222, 232 for receiving a respective end of the first and second side frame portions 12*a*, 12*b* (or 14*a*, 14*b*) to allow the frame sides to be folded thereby reducing the length of the frame assembly from its unfolded length. The frame connectors 220, 230 are each pivotally moveable between generally opposing deployed (or locked), shown in FIG. 3, and folded, shown in FIG. 8, positions. The limits of the frame connectors 220, 230 are established by interaction between a limiter structure 229, 239 on the respective frame connectors and stop structures within the housing. When in the deployed position, each limiter 229, 239 contacts a first stop 218, 219 within the body 210; when the frame is folded, the limiters 229, 239 contact a second stop, which in this embodiment is an interior surface of the body 210 adjacent to aperture 214, 215 through which each frame connector 220, 230 partially projects. Each aperture 214, 215 is sized to prevent the respective limiters 229, 239 from passing therethrough. In other embodiments, dedicated stop structures may be provided in the interior of the body.

The first frame connector 220 is configured so that limiter 229 permits connector movement about pivot axis 212 through an angle that is greater than 90 degrees. The second frame connector 230 is configured so that limiter 239 permits connector movement about pivot axis 213 through an angle that is less than 90 degrees. In the embodiment illustrated, the first frame connector pivots approximately 125 degrees between the folded and deployed positions while the second frame connector 230 pivots approximately 55 degrees between the folded and deployed positions. The pivot angles are easily altered to suit specific folding frame designs by varying the configuration of the frame connectors 220, 230 and/or the stops 218, 219. Such alterations result in variations in the offset provided by the lock assembly 20 when folded. Once established, the pivot angle limits are non-adjustable. When each frame connector 220, 230 is moved to the folded position, the body 210 is not perpendicularly aligned with either side frame portion, but is angled. The angling of the body 210, or more specifically the angling of an axis extending between the pivots 212, 213 relative to the side frame portions offsets the distal ends of the side frame portions so that the end frame members 13, 15 are not aligned to contact, even though equal-length side frame portions are used. The result is improved production efficiency by allowing the first and second side frame portions to be identically made while providing a more compact offset folding frame.

Figure 8:
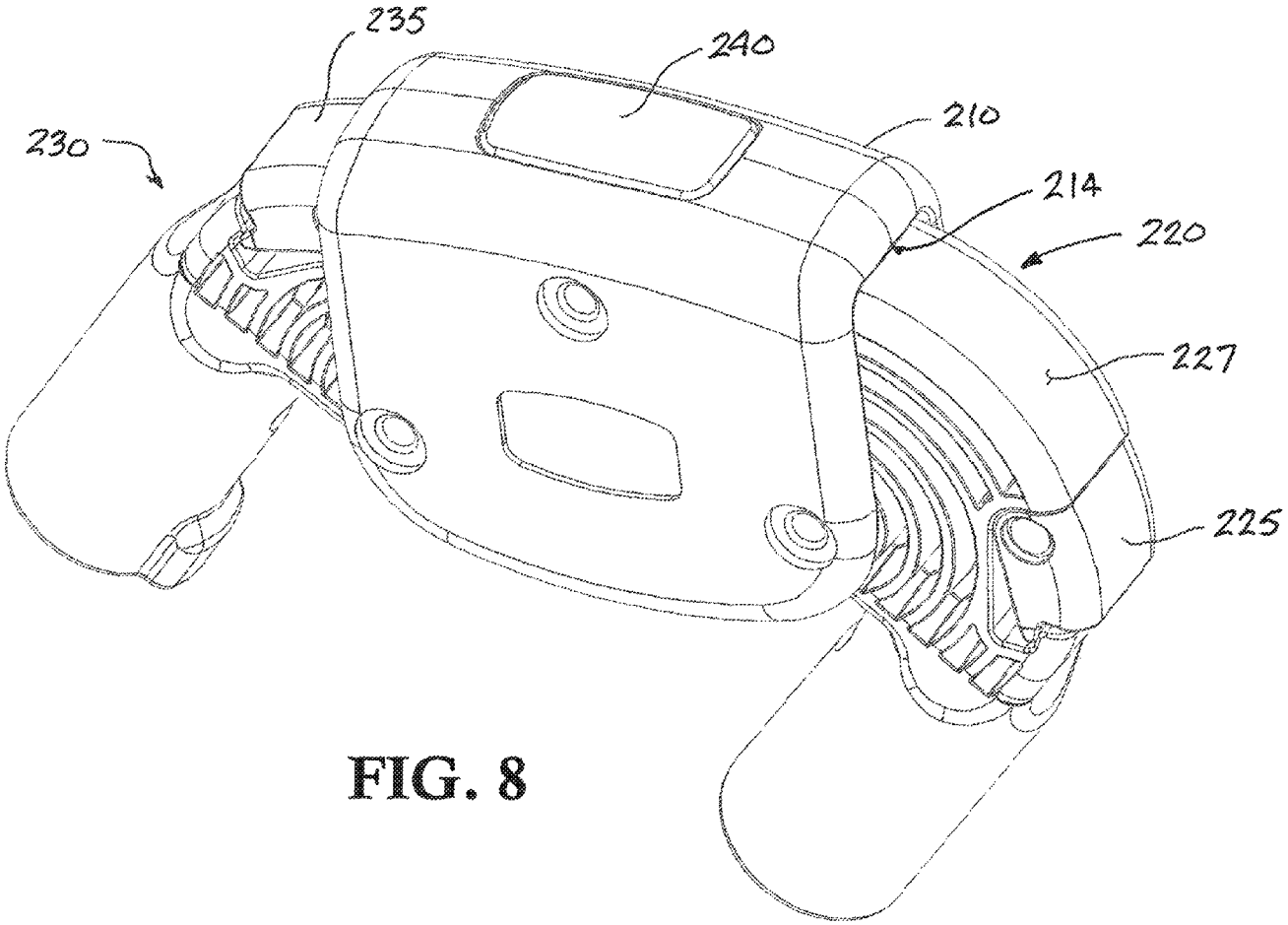
FIG. 8 is a second view of the folding lock assembly as shown in FIG. 6.

The frame connectors 220, 230 each include a radiused surface 227, 237 which is substantially uniformly spaced from the respective pivot axes 212, 213 so that a consistent and minimal space is maintained between the frame connector and the respective adjacent edge of aperture 214, 215 as the frame connectors are rotated between the deployed (locked) position (FIG. 3) and the folded position (FIG. 8). By minimizing the gap between the radiused surface and the aperture 214, 215, the potential for pinching a user's finger between the frame connector and the housing as the frame is repositioned from a folded configuration to a deployed configuration is minimzed.

Figure 4:
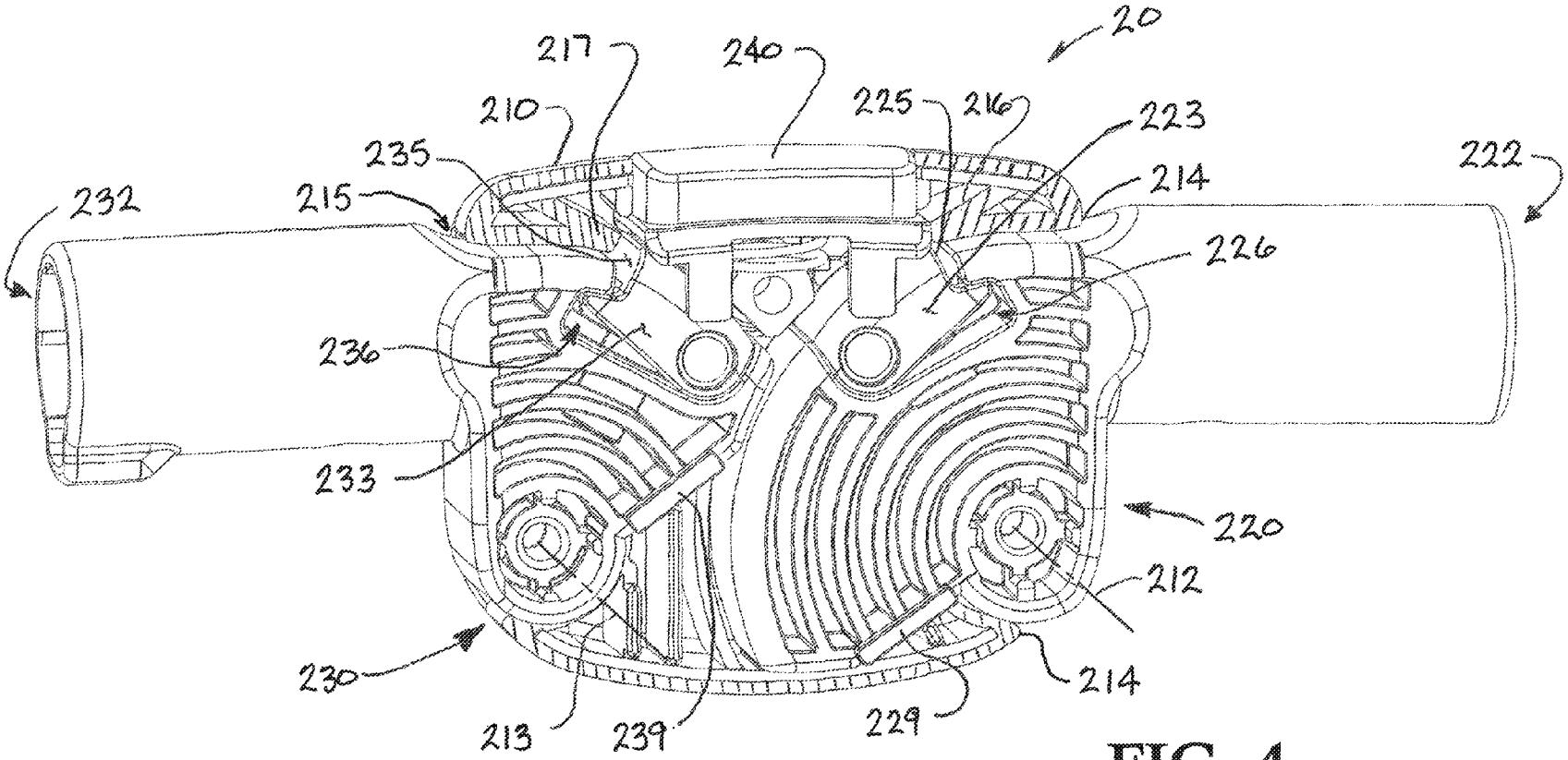
FIG. 4 is a perspective view of the folding lock assembly of FIG. 3 with the front portion of an exterior cover removed to illustrate the internal structure with the folding lock assembly positioned for use.
Figure 5:
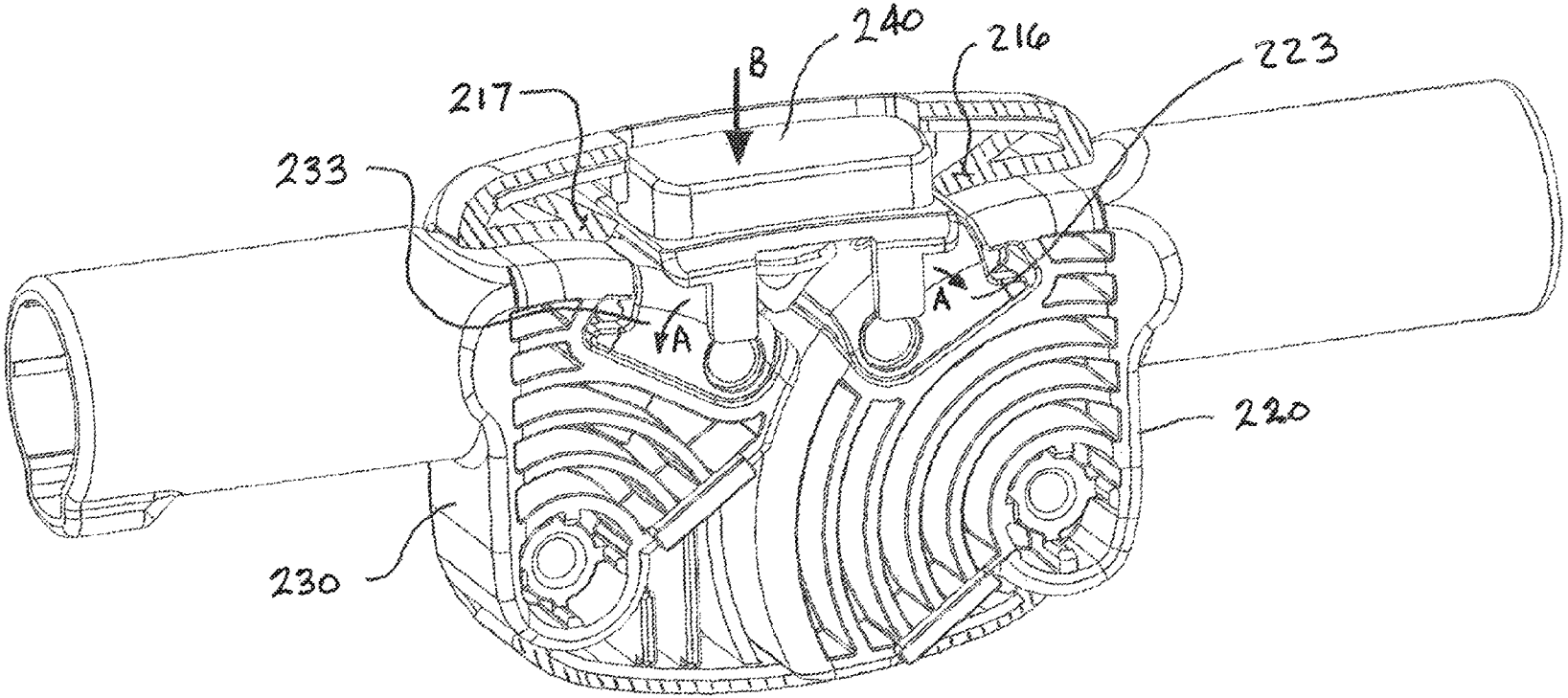
FIG. 5 is a second view of the folding lock assembly of FIG. 3 showing the folding lock assembly internal configuration as the lock is a released in preparation for folding.
Figure 6:
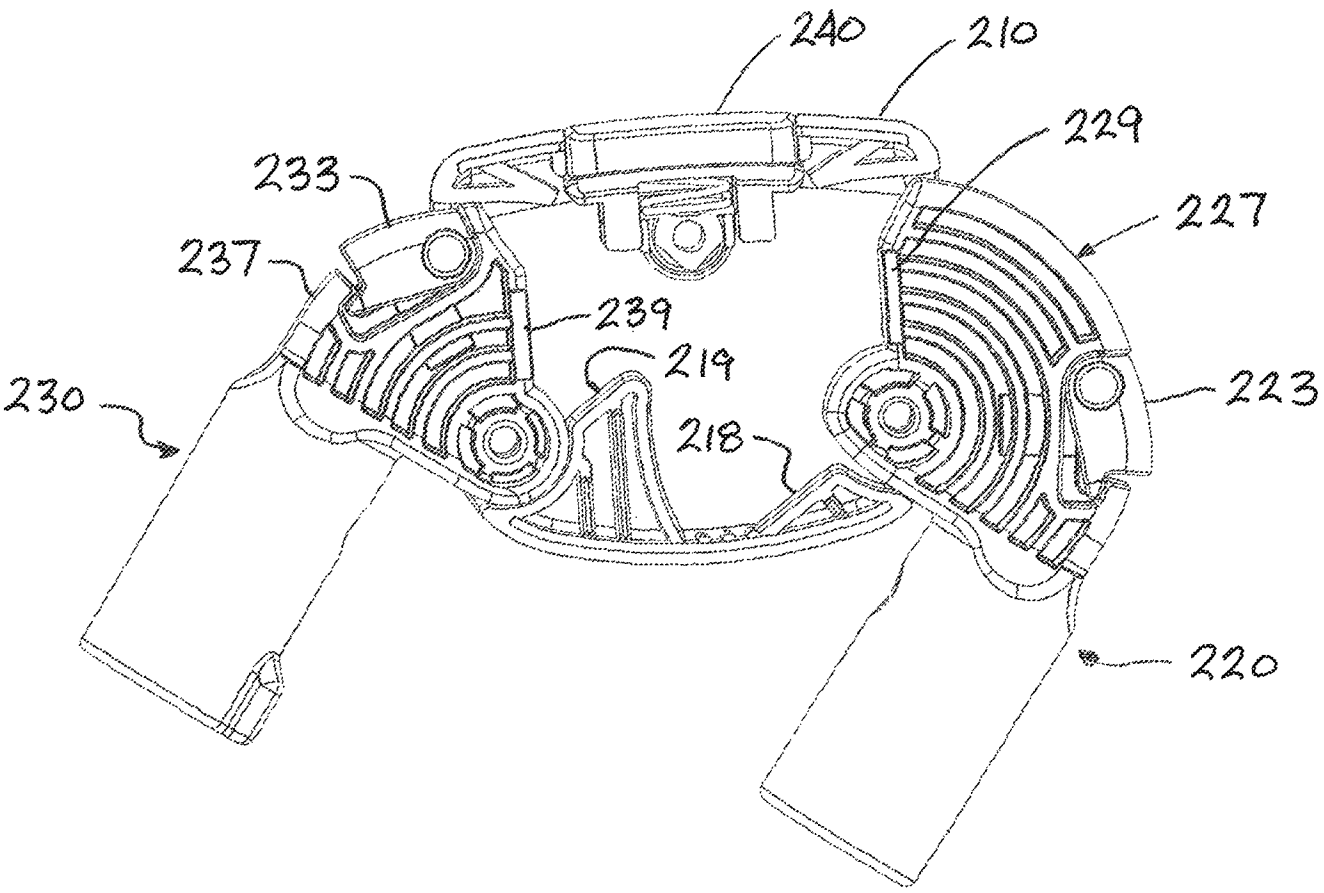
FIG. 6 is a perspective view of the folding lock assembly of FIG. 3 showing the folding lock assembly in a folded position.
Figure 7:
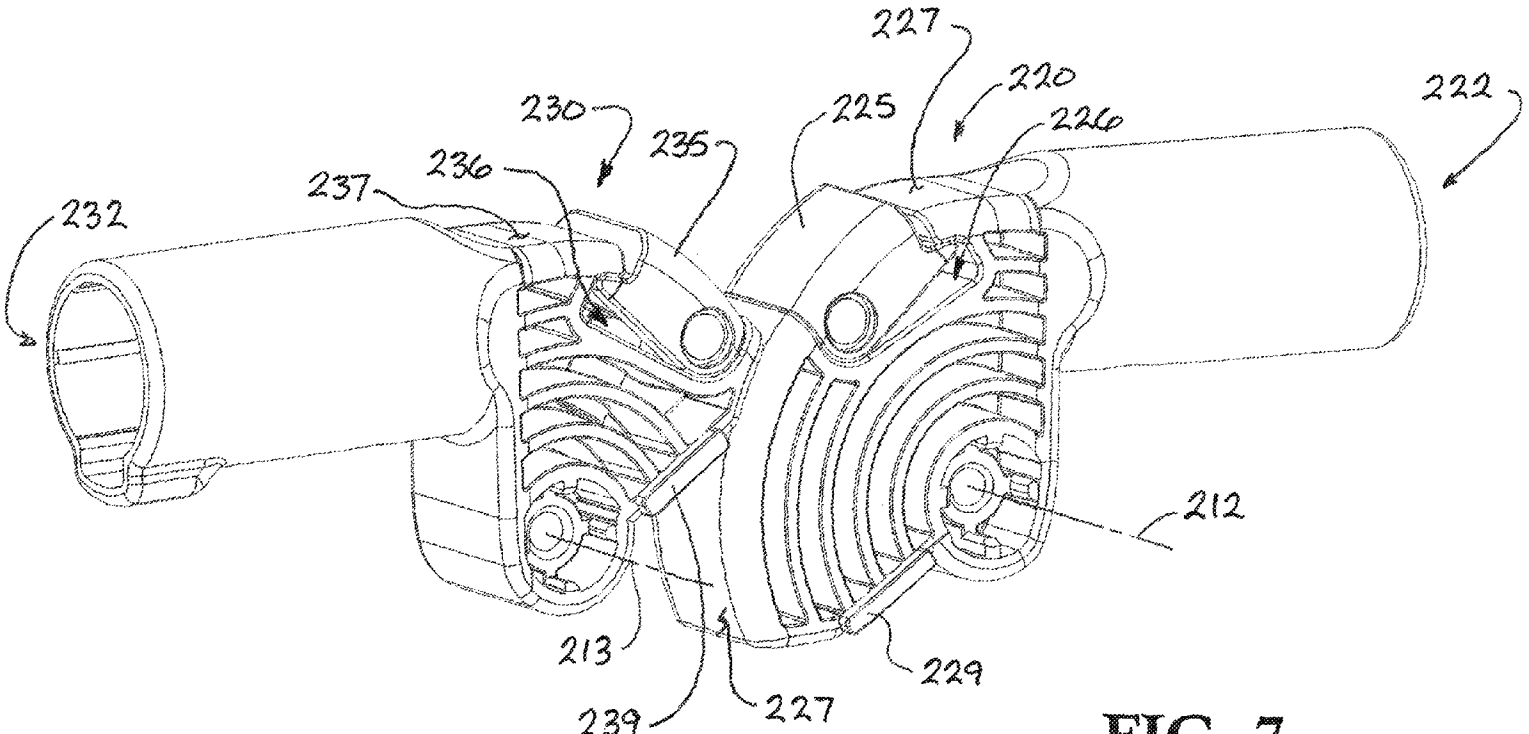
FIG. 7 is a partial view of the folding lock assembly showing only frame connectors and locking elements.

Each frame connector further includes a locking element 223, 233 which is pivotally connected to the respective frame connector and disposed within a respective recess 226, 236 in the frame connector. In the embodiment illustrated, the locking elements are configured as ratchet pawls which allow uninhibited movement in one direction while inhibiting movement in the opposite direction unless disengaged. The locking elements are pivotally connected to respective frame connectors at one end and biased to cause the opposite end to project toward an extended position, as shown in FIG. 4, so that locking element surfaces 225, 235 engage lock stops 216, 217 in the housing 210 to inhibit rotation of the respective frame connectors in the folding direction while the locking elements are extended. As shown in FIG. 5, the locks are released by a release button 240 which interacts with the locks when depressed (direction arrow "B" shown) to pivot the locks as indicated by arrows "A" into their respective lock recesses 226, 236 so that the lock surfaces 225, 235 no longer interact with the lock stops 216, 217 allowing the frame connectors 220, 230 to be pivoted from the locked position. The locking elements 223, 233 are biased to normally engage the lock stops 216, 217 when so positioned; depressing the release button overcomes the biasing force on the locking elements to move them fully into the lock recesses 226, 236, disengaging the locking elements from the stops 216, 217 and allowing the frame connectors 220, 230 to rotate. The pivot location of the locking elements 223, 233 allows the frame connectors to be rotated from the folded position toward the deployed position without inhibition by the locking elements, but requires that the locking elements be released or disengaged before the frame can be moved from the deployed position toward the folded position.

In FIG. 8, the frame connectors 220, 230 are shown in the folded configuration. The radius surfaces 227, 237 in combination with the locks 223, 233 fill the opening of the body to prevent gaps between the relatively stationary body 210 and the moving frame connectors 220, 230 which could pinch a user's hand or finger during the frame movement.

Figure 9:
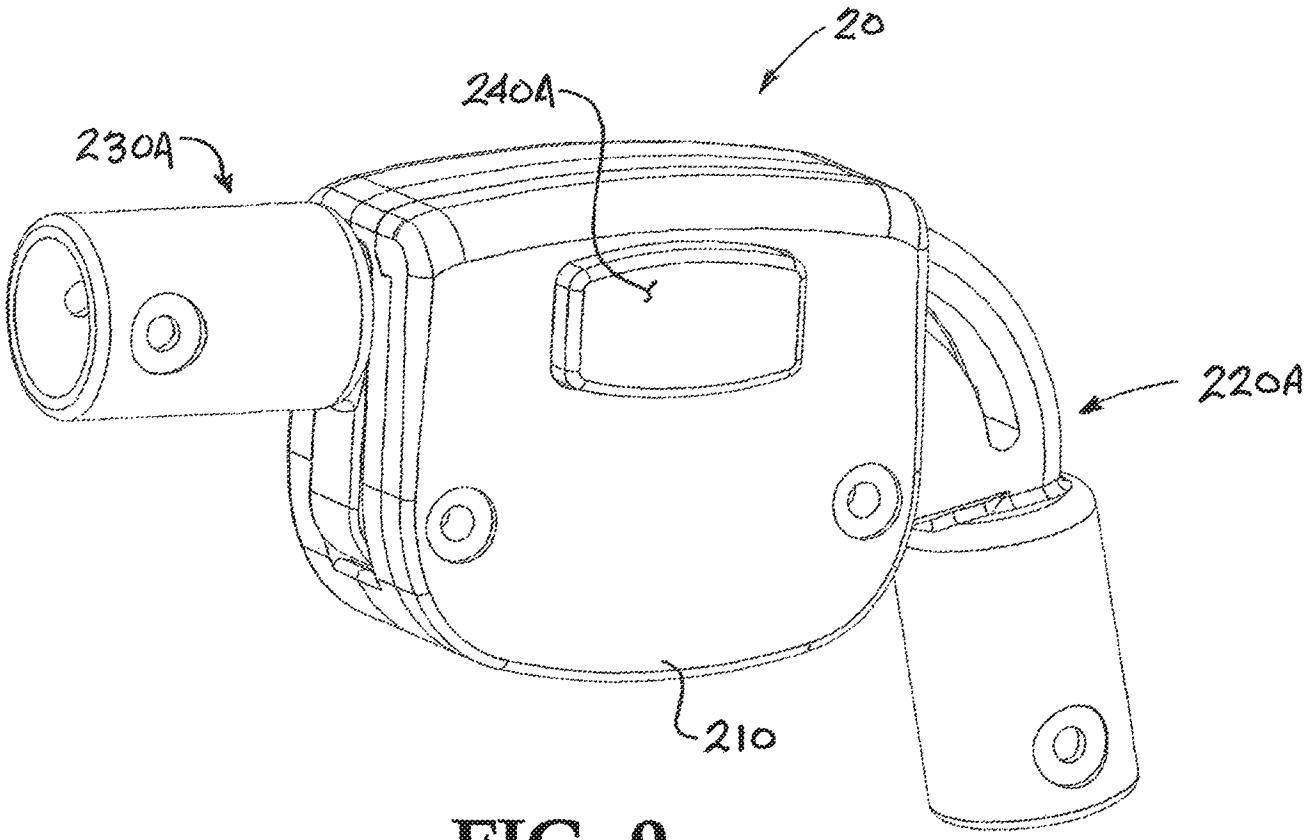
FIG. 9 shows a second embodiment of the present folding lock assembly invention.
Figure 10:
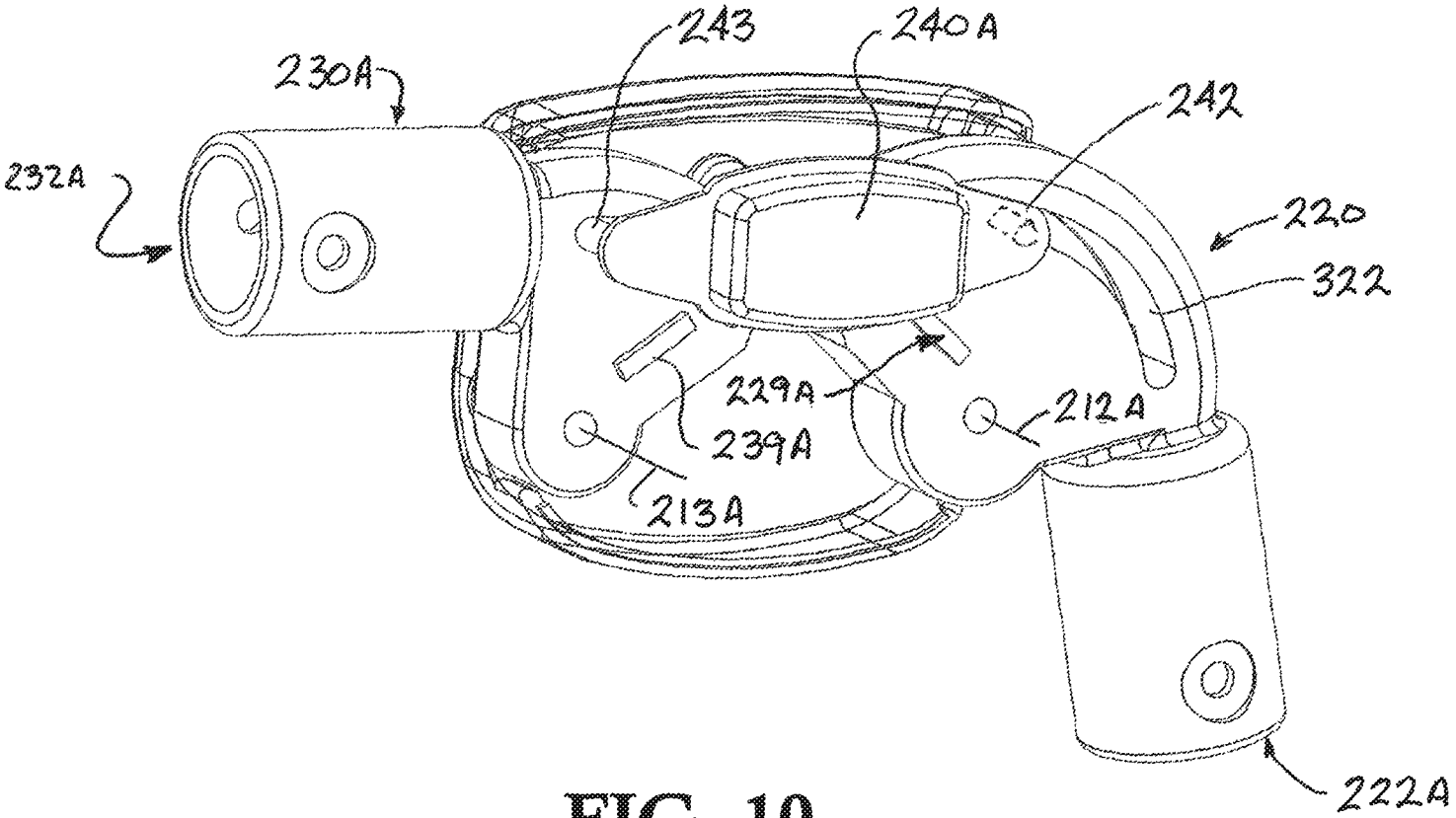
FIG. 10 shows the folding lock assembly of FIG. 9 with a portion of the body removed to illustrate the internal structure.
Figure 11:
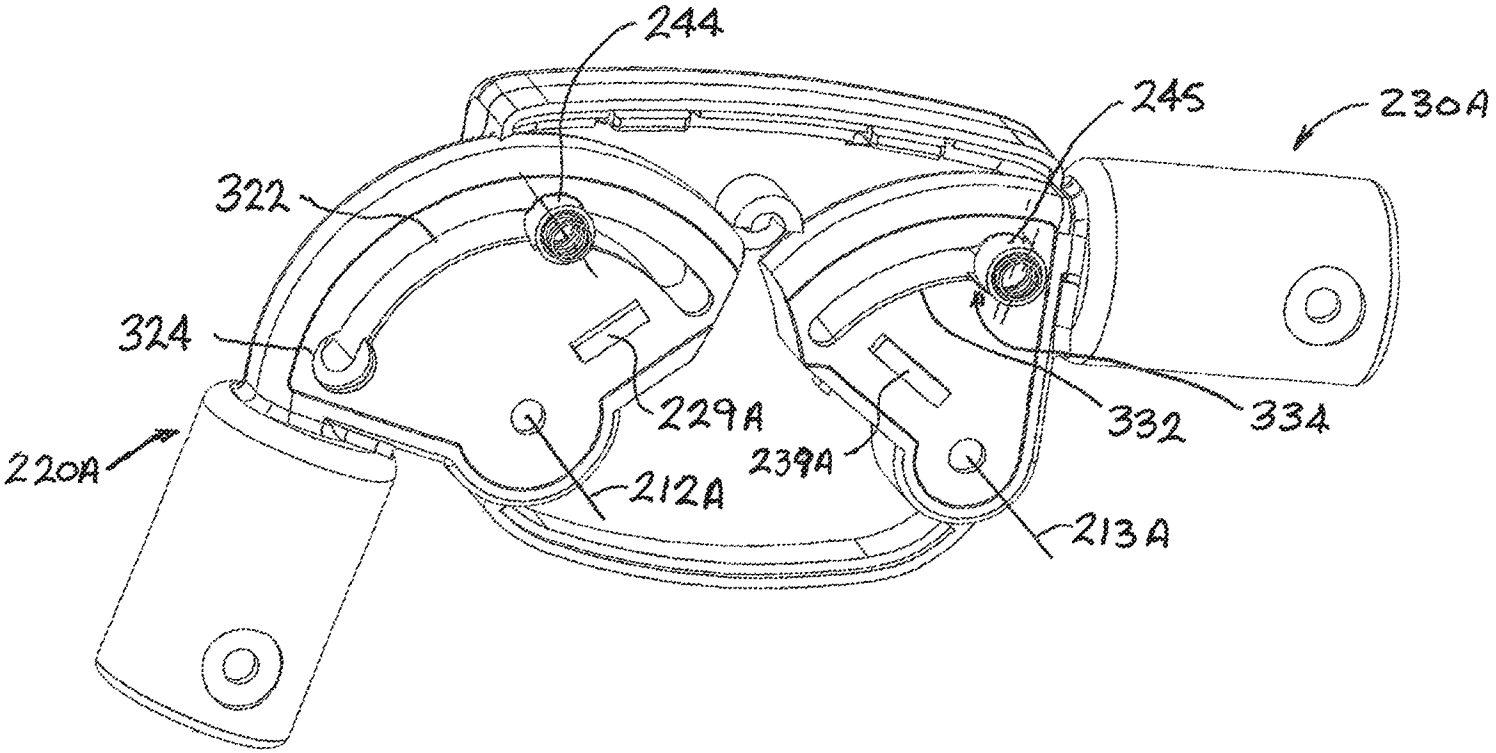
FIG. 11 shows the folding lock assembly of FIG. 10 from a reverse angle.

Now referring to FIGS. 9 through 11, a second embodiment of the folding lock assembly 20 is illustrated having an alternate locking means. In this embodiment, the release button 240A is disposed on the side of the body 210. The release button interacts with a pair of post-like locking elements 242, 243 extending generally transverse to the body 210. The locking elements have a width that allows each to extend into engagement with a slot-like cam 322, 332 in each frame connector 220A, 230A. The cams 322, 332 are of constant radius from the pivots 212A, 213A and have a generally uniform width so that the swing members may pivot while the locking elements 242, 243 remain engaged in the cams. The degree of pivotal movement of each frame connector 220A, 230A is controlled by the arc length of each cam. Each cam includes a detent 324, 334 at one end corresponding to the deployed position of the frame connectors. The detents have a width greater than that of the cam. A follower 244, 245 provided on the distal end of each post 242, 243 has a width greater than that of the locking element configured to be received into the detent when the cam is so aligned and inhibit further movement of the frame connectors while so engaged. The followers 244, 245 are biased to cause them to normally engage the respective detents 324, 334 when so aligned and inhibit the frame connector from pivoting movement. When the release button is depressed, the followers 244, 245 are moved out of engagement with the detents so that only the posts remain engaged in the cams 322, 332 and the frame connectors 220A, 230A may pivot freely. A second set of detents may be used at opposite end of the cams to retain the frame connectors 220A, 230A in the folded positions until released.

The second embodiment retains the same relative differences in the extent that each frame connector is allowed to pivot and the radiused surfaces to reduce pinch potential as previously described in relation to the first embodiment.

Naturally, the invention is not limited to the foregoing embodiments, but it can also be modified in many ways without departing from the basic concepts. It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

We claim:

1. A folding lock assembly for a child's play yard frame comprising:

a lock support structure;

a first rail connector pivotally coupled to the lock support structure for movement about a first pivot axis between generally opposing deployed and folded positions, the lock support structure being configured to limit pivotal movement of the first rail connector to a first angular displacement;

a second rail connector pivotally coupled to the lock support structure for movement about a second pivot axis parallel to and spaced apart from the first pivot axis between generally opposing deployed and folded positions, the lock support structure being configured to limit pivotal movement of the second rail connector to a second angular displacement;

first and second locking elements moveable between locked and released positions, the locking elements when in the locked position engaging the lock support structure when the respective rail connectors are in the deployed position to inhibit rail connector movement toward the folded positions;

a release actuator configured to simultaneously move the locking elements toward the released position; and a housing partially surrounding the first and second rail connectors, the housing having first and second apertures through which the first and second rail connectors partially extend, the rail connectors each having a radiused surface uniformly spaced apart from the respective pivot axes and disposed adjacent to respective edge portions of the respective apertures, the radiused surfaces configured to maintain a substantially uniform separation from the adjacent edge portions as the rail connectors are pivoted between the deployed and folded positions;

wherein the first angular displacement is less than ninety degrees and the second angular displacement is greater than ninety degrees.

2. The lock assembly of claim 1, wherein each locking element is configured as a pawl pivotally connected to the respective rail connector and each radiused surface includes a recess for receiving the respective pawl, the pawl extending outwardly beyond the radiused surface when in the locked position.

3. The lock assembly of claim 2, wherein the lock support structure includes at least one stop block for engaging each pawl when extended outwardly in the locked position, interaction between the pawls and the respective stop blocks retaining the respective rail connectors in the deployed positions.

4. The lock assembly of claim 1, wherein the first and second rail connectors each include a cam adjacent to the respective radiused surface and uniformly spaced apart from the respective pivot axis, and the locking elements are first and second cam followers each moveable between the locked and released positions, the cam followers when in the released position engaging the cam to permit movement of the respective rail connectors between their respective deployed and folded positions.

5. The lock assembly of claim 4, wherein each cam includes at least one stop location into which the respective follower may be axially moved to the locked position to inhibit pivotal movement of the respective rail connector.

6. The lock assembly of claim 5, wherein each cam comprises a slot with a width and each follower includes a first portion that may be received into the slot width, the first portion being engaged in the slot when the follower is in the released position, each cam further comprising a detent having a width greater than the cam width, and each follower further includes a second portion sized to permit engagement with the respective detent but not the cam width, the second portion being engaged in the detent when the follower is in the locked position.

7. The lock assembly of claim 1, wherein the first angular displacement is approximately fifty-five degrees and the second angular displacement is approximately one hundred twenty-five degrees.

8. A foldable frame assembly comprising:

a pair of spaced apart side frame members, each having a first portion and a second portion;

a pair of end frame members, one connected at each opposing end of the side frame members;

a pair of folding lock assemblies, one intermediately disposed on each side frame member connecting respective first and second portions, each lock assembly further comprising:

a lock support structure;

a first rail connector for attaching the first side frame portion to the lock assembly, the first rail connector pivotally coupled to the lock support structure for movement about a first pivot axis, the lock support structure being configured to limit pivotal movement of the first rail connector to a first angular displacement;

a second rail connector for attaching the second side frame portion to the lock assembly, the second rail connector pivotally coupled to the lock support structure for movement about a second pivot axis, the lock support structure being configured to limit pivotal movement of the second rail connector to a second angular displacement;

wherein the first angular displacement is less than ninety degrees and the second angular displacement is greater than ninety degrees.

9. The foldable frame of claim 8, wherein each rail connector is moveable between generally opposing deployed and folded positions, the rail connectors aligning the first and second frame side portions linearly when in the deployed position and aligning the first and second side frame portions generally parallel when in the folded position, an axis extending between the first and second pivot axes on the lock assembly being non-perpendicularly angled in relation to the side frame portions when rail connectors are in the folded position.

10. The foldable frame of claim 9, wherein each lock assembly further includes a pair of locking elements moveable between locked and a released positions, and a release actuator configured to simultaneously move the locking elements toward the released position, the locking elements when in the locked position engaging the lock support structure when the rail connectors are in the deployed position to inhibit rail connector movement toward the folded positions.

11. The foldable frame of claim 9, wherein the lock support structure includes a housing partially surrounding the first and second rail connectors, the housing having first and second apertures through which the first and second rail connectors partially extend, the rail connectors each having a radiused surface uniformly spaced apart from the respective pivot axes and disposed adjacent to respective edge portions of the respective apertures, the radiused surfaces configured to maintain a substantially uniform separation from the adjacent edge portions as the rail connectors are pivoted between the deployed and folded positions.

12. The foldable frame of claim 9, wherein the first angular displacement is approximately fifty-five degrees and the second angular displacement is approximately one hundred twenty-five degrees.

13. The foldable frame of claim 10, wherein each locking element includes a pawl pivotally connected to the respective rail connector and each radiused surface includes a recess for receiving the respective pawl, the pawl extending outwardly beyond the radiused surface when in the locked position.

14. The foldable frame of claim 13, wherein each lock support structure includes at least one stop block for engaging each pawl when extended outwardly in the locked position, interaction between the pawls and the respective stop blocks retaining the respective rail connectors in the deployed positions.

15. The foldable frame of claim 10, wherein the first and second rail connectors of each lock assembly each include a cam adjacent to the respective radiused surface and uniformly spaced apart from the respective pivot axis, and the locking elements are first and second cam followers each moveable between the locked and released positions, the cam followers when in the released position engaging the cam to permit movement of the respective rail connectors between their respective deployed and folded positions.

16. The foldable frame of claim 15, wherein each cam includes at least one stop location into which the respective follower may be axially moved to the locked position to inhibit pivotal movement of the respective rail connector.

17. The foldable frame of claim 16, wherein each cam comprises a slot with a width and each follower includes a first portion that may be received into the slot width, the first portion being engaged in the slot when the follower is in the released position, each cam further comprising a detent having a width greater than the cam width, and each follower further includes a second portion sized to permit engagement with the respective detent but not the cam width, the second portion being engaged in the detent when the follower is in the locked position.

* * * * *